United States Patent [19]

Ota

[11] Patent Number: 4,615,759

[45] Date of Patent: Oct. 7, 1986

[54] APPARATUS FOR PLACING VENEER PIECES IN EDGE-ABUTTING RELATIONSHIP

[76] Inventor: Masayuki Ota, 1-22-13, Minami, Meguro-ku, Tokyo, Japan

[21] Appl. No.: 623,949

[22] Filed: Jun. 25, 1984

[51] Int. Cl.[4] ..... B27D 1/10

[52] U.S. Cl. ..... 156/558; 38/143; 156/559

[58] Field of Search ..... 414/28; 156/560, 561, 156/558, 559, 582, 544, 545, 546, 557; 198/458, 495, 493; 26/99, DIG. 1; 38/143; 271/92, 184

[56] References Cited

U.S. PATENT DOCUMENTS

| | | | |
|---|---|---|---|
| 2,544,133 | 3/1951 | Carlson | 156/546 X |
| 2,686,586 | 8/1954 | Griffin | 198/493 |
| 2,934,110 | 4/1960 | Barker | 156/560 X |
| 3,426,558 | 2/1969 | Schmid | 38/143 X |
| 3,620,887 | 11/1971 | Nelson | 156/560 X |
| 3,963,555 | 6/1976 | Zweig | 156/559 X |
| 3,997,155 | 12/1976 | Martin | 271/184 X |
| 4,083,275 | 4/1978 | Lingl | 198/458 X |

FOREIGN PATENT DOCUMENTS

| | | | |
|---|---|---|---|
| 629070 | 8/1978 | U.S.S.R. | 271/184 |

*Primary Examiner*—Robert J. Spar
*Assistant Examiner*—Janice Krizek
*Attorney, Agent, or Firm*—Paul & Paul

[57] ABSTRACT

An apparatus for placing veneer pieces in edge-abutting relationship, which comprises an infeed section for flat-feeding the veneer pieces, one by one, in the horizontal direction perpendicular to the fibers of the pieces, including at least one positive feeder at one end of the infeed section, and a crowder section comprising a plurality of upper and lower longitudinal rotating rollers extending in the feeding direction and spaced in parallel to each other so as to define a free transporting passage following the infeed section. The veneer pieces are, in turn, held and pressurized from top and bottom by the upper and lower rollers with their respective edges being in contact with the edges of the adjacent veneer pieces. A succeeding veneer piece is fed by the positive feeder and, just before the positive feeding ceases, the front edges of the succeeding piece come into contact with the rear edges of a preceding veneer piece which has been held at the crowder section.

8 Claims, 6 Drawing Figures

APPARATUS FOR PLACING VENEER PIECES IN EDGE-ABUTTING RELATIONSHIP

BACKGROUND OF THE INVENTION

1. Field of the Invention

This invention relates generally to an apparatus for placing in abutment and adhering together the edges of veneer pieces, and more particularly to an apparatus which can be advantageously applied to attaching together by an adhesive such as glue the edges of thin or weak veneer pieces to form a wider veneer sheet.

2. Description of the Prior Art

In a conventional apparatus or method for forming wooden veneer pieces, an apparatus comprising a positive feeding station and a free transport passage for supporting the pieces from the top and bottom has been known, in which a veneer piece is transported, comes into abutment with a preceding veneer piece, and the contacting edges of these pieces are forced to adhere to each other through the pressure caused by the succeeding piece pushing against and thus feeding forward the preceding piece. Although this known technique has some advantages in that the edges can be stably placed in contact with each other, thus obtaining a strong bond between the veneer pieces, the frictional resistance generated between the free transporting passage and veneer pieces cannot be reduced. Therefore, if the body of the veneer pieces are weak in a direction perpendicular to the fibers, i.e., as in thin or weak veneer pieces, the veneer pieces may be damaged or buckled by the shock caused when the edge of the succeeding piece come into abutment or collide with the edge of the preceding piece. The above problem in the conventional apparatus sometimes has an adverse effect on the adhering together of the edges of veneer pieces.

SUMMARY OF THE INVENTION

An object of the present invention is to provide a new and improved apparatus for placing veneer pieces in edge-abutting relationship, in which the disadvantages of the prior art are obviated or eliminated.

Another object of the present invention is to provide an apparatus for placing veneer pieces in edge-abutting relationship, in which the frictional resistance normally generated between the free transporting passage and veneer pieces is changed to a kinetic friction, by feeding veneer pieces through a free passage defined by upper and lower longitudinal rollers which are positively rotated, thus considerably reducing this friction and thereby moderating the shock normally generated when the edges of the succeeding veneer piece come into abutment with the edges of the preceding piece.

According to the present invention, there is provided an apparatus for placing veneer pieces in edge-abutting relationship with each other, comprising an infeed section for flat-feeding the veneer plates, one by one, in a horizontal direction perpendicular to the fibers of the pieces, including at least one positive feeding means at one end of the infeed section, and a crowder section comprising a plurality of upper and lower longitudinal rotating rollers extending in the feeding direction and spaced in parallel to each other so as to define a free transporting passage following the infeed section, in which the veneer pieces are in turn, held and pressurized top and bottom by the upper and lower rollers with their edges in contact with the edges of the adjacent veneer pieces, so that a succeeding veneer piece is fed by the positive feeding means and, just before the positive feeding ceases, the front edge of the succeeding piece comes into abutment with the rear edge of a preceding veneer piece held at the crowder section.

The claimed invention makes it possible to change the frictional resistance generated between the upper and lower rollers and the upper and lower surfaces of the veneer pieces to a small kinetic frictional resistance, since the veneer pieces are fed through a free passage defined by the upper and lower longitudinal rollers which are positively rotated. Therefore, the preceding veneer piece can be pushed and moved very smoothly, with very little force, by the succeeding veneer piece, and the shock normally generated when the contact or collision therebetween takes place is considerably moderated.

The present invention is advantageous in that the upper and lower rotating rollers are arranged in such a manner that individual said rollers are spaced in parallel to each other and arranged zigzag, so that the veneer pieces are supported in the crowder section in a corrugated configuration in the direction perpendicular to the fibers of the pieces.

The upper and lower longitudinal rotating rollers may also be arranged in such a manner that each pair of upper and lower rollers is spaced in parallel to each other pair of upper and lower rollers, and each pair of rollers consists of an upper and lower roller. The vertical position of each pair of upper and lower rollers may be advantageously differed alternately, so that the veneer pieces are supported in the crowder section in a corrugated configuration in the direction perpendicular to the fibers of the plates. According to such an arrangement, even a thin or weak veneer piece which has little strength in the direction perpendicular to the fibers can be protected from damage and buckling when a collision takes place, thereby giving rise to a smooth trouble-free operation.

The present invention is also advantageous in that the rotating direction of the upper rollers in the left side area is different from that of the upper rollers in the right side, and the rotating direction of the lower rollers in the left side area is different from that of the lower rollers in the right side area with respect to the feeding direction, so that the rotation of the upper and lower rollers tends to exert an outward force to the veneer pieces in the crowder section. Such an arrangement makes it possible to prevent misalignment of the veneer pieces with each other in the direction of the fibers of the pieces when the veneer pieces are moved in the crowder section.

It is also advantageous in that means are provided for forming a liquid film over the outer surfaces of the upper and lower rollers, to further reduce the frictional resistance between the upper and lower rollers and the veneer pieces.

Therefore, the present invention will be very useful and will make a great contribution in the field of making plywood which is widely used in various industrial fields.

PREFERRED EMBODIMENTS OF THE INVENTION

Figure 1:
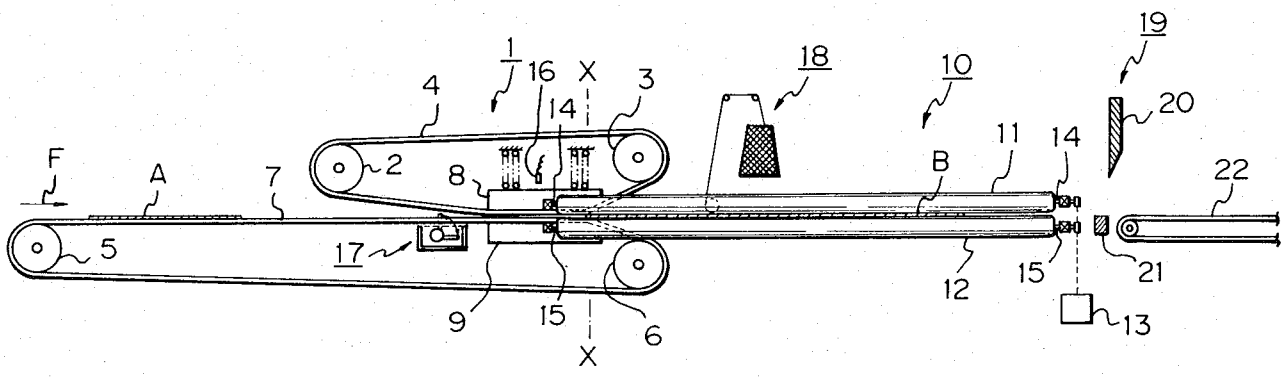
FIG. 1 is a longitudinal elevational view of an embodiment of an apparatus for adhering the edges of veneer pieces according to the present invention.

Referring now to the drawings, an infeed section 1 comprises a plurality (in this embodiment, three) of upper endless belts 4 arranged in parallel and extending over front and rear upper pulleys 2 and 3, and a plurality (in this embodiment, three) of lower endless belts 7 arranged in parallel in correspondence with the upper belts 4 and extending over front and rear lower pulleys 5 and 6. A veneer piece A having a relatively small width is transported by these endless belts 4 and 7 in the direction F perpendicular to the direction of the fibers of the piece. At the ends of the endless belts 4 and 7, pressurizing members 8 and 9 are provided to pressurize the backs of the belts 4 and 7, respectively, so that the piece A is positively fed while passing through the pressurizing members 8 and 9; at the ends of which the pressurizing force ceases at line X—X.

A crowder section 10 comprises a plurality of pairs of upper and lower longitudinal rollers 11 and 12, in this embodiment, six pairs of upper and lower rollers 11 and 12, which cooperatively define a free transport passage, and catch and support therebetween the single veneer plate A received from the infeed section 1 and a preceding veneer piece B. In this crowder section 10, the front edge of the succeeding piece A is in abutment with the rear edge of the preceding piece B. The axes of these upper and lower rollers 11 and 12 extend in substantially the same direction as the transporting direction F of the pieces. The length of these rollers 11 and 12 in the transporting direction F is appropriately chosen in accordance with the thickness of the veneer pieces, and the time needed for hardening of the adhesive applied to the edges of the veneer pieces, etc. The upper and lower rollers 11 and 12 are rotated by any suitable driving means 13, such as an electric motor, via the respective shafts of the rollers 11 and 12 or drive rollers (not shown) directly in contact with these rollers 11 and 12, which can be constantly rotated or rotated only when the succeeding piece A is pushing the preceding piece B. In the latter case, the rollers 11 and 12 can be rotated by any suitable means, for instance, a detector 16 provided in the infeed section 1 for detecting the front and rear edges of the veneer piece A during their passage therethrough, and transmitting the signals thereof to the driving means 13.

Figure 2:
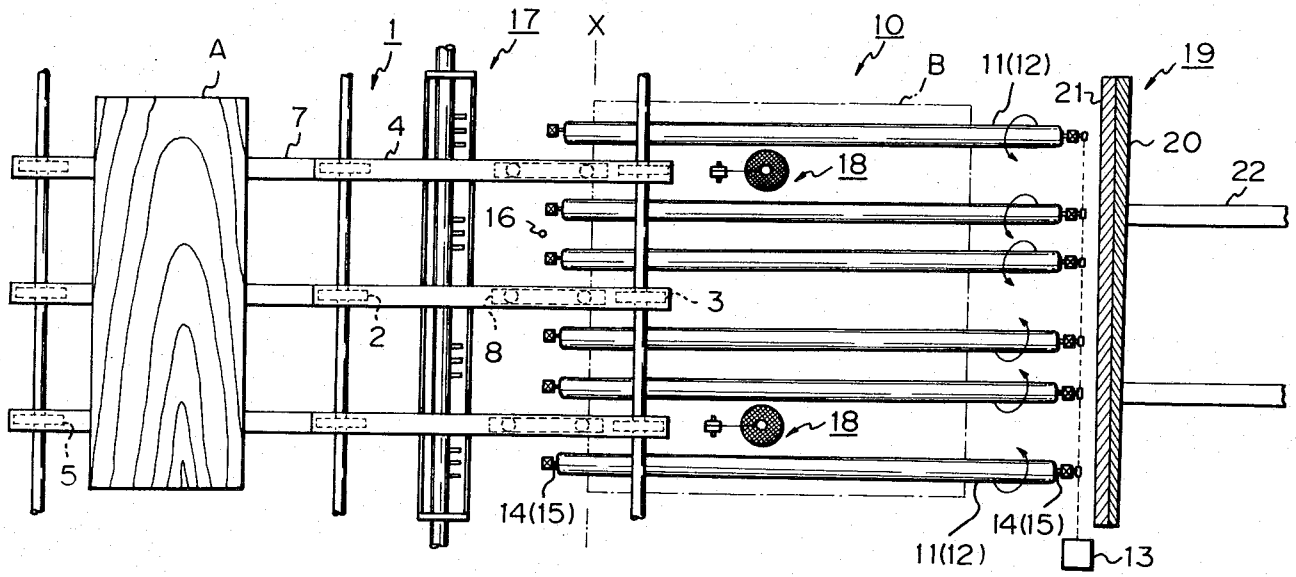
FIG. 2 is a plan view of the apparatus shown in FIG. 1.
Figure 3:
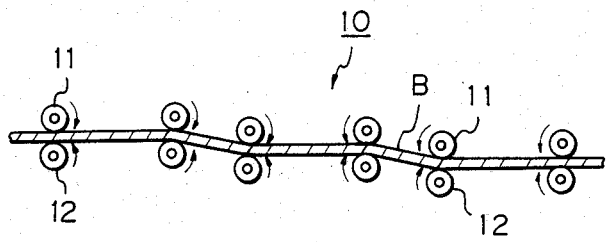
FIG. 3 is a schematic illustration of a crowder section.
Figure 4:
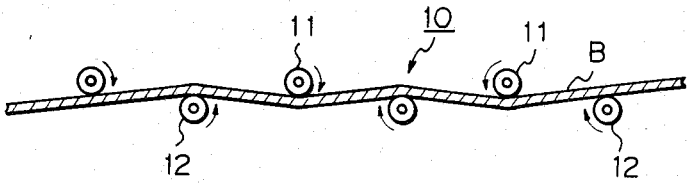
FIG. 4 is a schematic illustration similar to FIG. 3, but shows another roller arrangement.

As shown in FIGS. 2, 3 and 4, the present invention is advantageous in that the rotating direction of the upper and lower rollers 11 and 12 in the left side area is different from that of the right side rollers, so that any misalignment of the preceding and succeeding pieces B and A, respectively, in the direction of fibers thereof is prevented. The respective upper and lower rollers 11 and 12 may or may not be positioned in correspondence to each other in the up-and-down direction, as illustrated in FIG. 3 or FIG. 4, but must always constitute a free transport passage for supporting the veneer pieces therebetween.

The veneer pieces come into abutment with and are adhered to the adjacent veneer pieces by their respective edges in a manner as mentioned below.

The veneer piece A is, in turn, transported in the direction perpendicular to the fibers of the piece through the infeed section 1 and fed to the crowder section 10 from the positive feeding portion comprising the pressurizing members 8 and 9. When the rear edge of veneer piece passes the line X—X, where the positive feeding ceases, the veneer piece stops and becomes plate B. The front edge of the next or succeeding veneer piece A comes, in turn, into abutment with the rear edge of the preceding veneer piece B, pushes piece B forward, and stops when the rear edge of the succeeding piece A passes the line X—X where the positive feeding force action ceases.

The above-mentioned operation is repeated and, in the crowder section 10, several of the preceding veneer pieces B are formed with their edges in contact with the respective edges of the adjacent veneer pieces. The frictional resistance generated between the rollers 11 and 12 and the preceding piece B or succeeding piece A is a kinetic frictional resistance and is very small, since in the crowder section 10 a free transport passage is defined between the upper and lower rollers 11 and 12, which rotate while the succeeding veneer piece A comes into contact with and pushes the preceding veneer piece B forward. Therefore, the preceding piece B can be moved smoothly with a very slight force when the succeeding piece A comes into abutment with and pushes the preceding piece B, and thus the shock of the collision therebetween is very small.

Therefore, even a thin or weak veneer piece which has little strength in the direction perpendicular to the fibers of the piece can be protected from damage and buckling when the collision and pushing take place, thereby giving a smooth and trouble-free operation with a favorable edge contact.

In the drawings, a glue applicator 17 is provided for applying a suitable adhesive or glue, such as hot melt glue or the like, to the front edge of the veneer piece A when passing through the infeed section 1 so that the succeeding veneer piece A is joined by its front edge to the rear edge of the preceding veneer piece B, to form a wider veneer sheet. In the crowder section 10, stitching or taping devices 18 are provided for stretching and attaching strings or tapes over the surfaces of the preceding veneer plates, which have been adhered to each other by their respective edges in the direction perpendicular to the fibers of the pieces by a suitable adhesive such as hot melt glue or the like. A cutting device 19 comprises a movable cutter 20 and a stationary cutter 21 to cut the spliced preceding veneer pieces B into a veneer sheet of a predetermined width. Outfeed conveyers 22 are provided to transfer the veneer sheet of a predetermined width to the subsequent process or station, such as a stacking station (not shown).

FIG. 3 illustrates an arrangement of the upper and lower rollers 11 and 12, wherein the vertical positions thereof are differed alternately, so that the preceding veneer pieces B and the front portion of the suceeding veneer piece A are supported in the crowder section 10 in a corrugated manner in the direction perpendicular to the fibers of the pieces, making it possible to sufficiently strengthen the bodies of the veneer pieces so that it will absorb the shock normally occurring when contact or collision takes place, even if the veneer pieces are very thin.

FIG. 4 illustrates another roller arrangement, wherein the individual upper and lower rollers 11 and 12 are arranged zigzag so as to define therebetween a corrugated crowder section, similar to the embodiment shown in FIG. 3.

Figure 5:
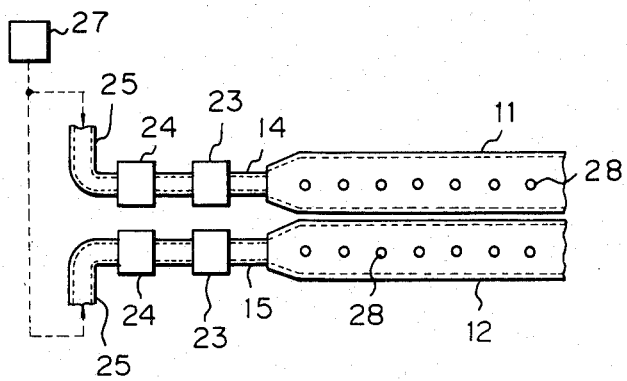
FIG. 5 is an elevational view of a pair of upper and lower rollers for forming a liquid film on the outer surfaces thereof; and, FIG. 6 is a cross-sectional view of the upper and lower rollers with a liquid film formed over the outer surfaces thereof.
Figure 6:
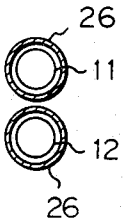

FIG. 5 illustrates an embodiment of upper and lower rollers 11 and 12 which constitute a free holding or transporting passage between which veneer pieces are supported from top and bottom, wherein the roller bodies 11 and 12 and the shafts 14 and 15 thereof, rotatably supported by bearings 23, are both hollow and cylindrical, and the hollow shafts 14 and 15 are connected by rotary joints 24 and pipes 25 to a fluid source 27 for supplying a liquid 26 such as water. The upper and lower hollow rollers 11 and 12 are each provided with a large number of apertures 28 over the outer surfaces thereof, and the liquid is introduced to the outer surfaces of the rollers 11 and 12 through the apertures 28 to form a film of liquid 26, as illustrated in FIG. 6. The introduction of the liquid film further reduces the frictional resistance generated between the respective rotating rollers 11 and 12 and the preceding veneer pieces B.

I claim:

1. An apparatus for placing veneer pieces in edge-abutting relationship with each other, comprising an infeed section for flat-feeding the veneer pieces, one by one, in the horizontal direction perpendicular to fibers of the veneer pieces, including at least one positive feeding means at one end of the infeed section, and a crowder section comprising a plurality of upper and lower longitudinal rotating rollers, having axes extending substantially in said feeding direction, and spaced in parallel to each other so as to define a free transporting passage following said infeed section, in which the veneer pieces are in turn, held and pressurized from top and bottom by said upper and lower rollers with their respective edges being in contact with the edges of the adjacent veneer pieces, so that a succeeding veneer piece is fed by said positive feeding means and, just before the positive feeding ceases, the front edges of the succeeding veneer piece come into contact with the rear edges of a preceding veneer piece which has been held at the crowder section.

2. An apparatus as set forth in claim 1, wherein the upper and lower rollers are arranged in such a manner that individual said rotating rollers are spaced in parallel to each other and arranged zigzag, so that the veneer pieces are supported in the crowder section in a corrugated configuration in the direction perpendicular to the fibers of the pieces.

3. An apparatus as set forth in claim 1, wherein the upper and lower longitudinal rotating rollers are arranged in such a manner that each pair of upper and lower rollers is spaced in parallel to each other pair of upper and lower rollers, and each pair of rollers consists of an upper and lower roller.

4. An apparatus as set forth in claim 3, wherein the vertical positions of each pair of upper and lower rotating rollers are differed alternately, so that the veneer pieces are supported in the crowder section in a corrugated configuration in the direction perpendicular to the fibers of the pieces.

5. An apparatus as set forth in claim 1, further comprising means for forming a liquid film over the outer surfaces of the upper and lower rollers.

6. An apparatus as set forth in claim 1, further comprising means for lubricating the outer surfaces of the upper and lower rollers.

7. An apparatus as set forth in claim 6, wherein said lubricating means includes said rollers, said rollers being hollow and having apertures in their surfaces, whereby a fluid supplied to the hollow of a roller is introduced to its outer surface through said apertures.

8. An apparatus for placing veneer pieces in edge-abutting relationship with each other, comprising an infeed section for flat-feeding the veneer pieces, one by one, in the horizontal direction perpendicular to fibers of the veneer pieces, including at least one positive feeding means at one end of the infeed section, and a crowder section comprising a plurality of upper and lower longitudinal rotating rollers extending in said feeding direction and spaced in parallel to each other, the rotating direction of the upper rollers in a left side area being different from that of the upper rollers in a right side area, and the rotating direction of the lower rollers in the left side area being different from that of the lower rollers in the right side area, with respect to the feeding direction, so that the rotation of the upper and lower rollers tends to exert an outward force to the veneer pieces in the crowder section, said rollers defining a free transporting passage following said infeed section, in which the veneer pieces are in turn, held and pressurized from top and bottom by said upper and lower rollers with their respective edges being in contact with the edges of the adjacent veneer pieces, so that a succeeding veneer piece is fed by said positive feeding means and, just before the positive feeding ceases, the front edges of the succeeding veneer piece come into contact with the rear edges of a preceding veneer piece which has been held at the crowder section.

* * * * *